US005647209A

United States Patent [19]

Wilcox

[11] Patent Number: 5,647,209

[45] Date of Patent: Jul. 15, 1997

[54] FASTENER INSTALLATION TOOL WITH POSITIVE PRESSURE PINTAIL REMOVAL SYSTEM

[75] Inventor: Robert B. Wilcox, Woodstock, N.Y.

[73] Assignee: Huck International, Inc., Kingston, N.Y.

[21] Appl. No.: 490,697

[22] Filed: Jun. 16, 1995

Related U.S. Application Data

[63] Continuation-in-part of Ser. No. 427,599, Apr. 24, 1995, abandoned.

[51] Int. Cl.[6] ..... F16D 31/02; B21D 9/05

[52] U.S. Cl. ..... 60/413; 91/4 R; 72/453.17; 72/391.2

[58] Field of Search ..... 91/4 R, 445; 60/404, 60/408, 413; 72/453.17, 453.19, 391.2, 391.4

[56] References Cited

U.S. PATENT DOCUMENTS

| | | | |
|---|---|---|---|
| 3,375,883 | 4/1968 | Schadlich | 173/170 |
| 3,528,277 | 9/1970 | Perkins | 72/391.2 |
| 4,005,598 | 2/1977 | Ehmann et al. | 72/391 |
| 4,120,188 | 10/1978 | Schwab | 72/453.17 X |
| 4,275,583 | 6/1981 | Gilbert et al. | 72/391 |
| 4,281,531 | 8/1981 | Ehmann et al. | 72/391 |
| 4,351,179 | 8/1982 | Fiebiger | 72/391 |
| 4,515,005 | 5/1985 | Klein | 72/391 |
| 4,517,820 | 5/1985 | Oefinger et al. | 72/391 |
| 4,598,571 | 7/1986 | Oefinger | 72/391 |
| 4,813,261 | 3/1989 | Rosier | 72/453.17 X |
| 4,887,450 | 12/1989 | Gast et al. | 72/391 |
| 4,888,974 | 12/1989 | Mandell | 72/391 |
| 4,896,522 | 1/1990 | Rosier | 72/391 |
| 4,964,292 | 10/1990 | Kaelin et al. | 72/453.17 |
| 4,988,442 | 2/1991 | Rosier | 72/391.2 |
| 5,119,554 | 6/1992 | Wilcox | 29/252 |
| 5,142,774 | 9/1992 | Jeffery | 29/810 |
| 5,146,773 | 9/1992 | Rosier | 72/391.4 |

OTHER PUBLICATIONS

GESIPA Blindniettechnik GmbH, *GESIPA –Blind Riveting Tool Ph 2*, Service Instruction and Spare Part List, (Jul. 1987).

GESIPA Blindniettechnik GmbH, *Vacuum Absorption System for Blind Riveting Power Tools PH 1 and PH2*, Operating and Service Instructions with Spare Parts List, (no date).

LOBTEX CO., Ltd., New Lobster Vacuum Unit, Product Brochure and Installation Instructions, (no date).

*Primary Examiner*—Hoang Nguyen

*Attorney, Agent, or Firm*—Cushman Darby & Cushman IP Group of Pillsbury Madison & Sutro, LLP; Ronald L. Lyons, Esq.

[57] ABSTRACT

A tool for use in installing fasteners in workpieces is disclosed. The tool includes a pintail bore which includes a passage extending through the nose assembly, the piston, and the back cap. An air channel connected to a supply of pressurized air is connected to the pintail bore. An air restriction mechanism blocks the flow of air out the nose of the tool and a pintail retaining device prevents detached pintails from exiting out the nose of the tool. Thus, pressurized air flowing through the air channel carries detached pintails out the pintail bore to a pintail collection chamber.

16 Claims, 6 Drawing Sheets

FASTENER INSTALLATION TOOL WITH POSITIVE PRESSURE PINTAIL REMOVAL SYSTEM

BACKGROUND

1. Related U.S. Application

This application is a continuation in part of U.S. patent application Ser. No. 08/427,599 filed Apr. 24, 1995 and entitled PNEUDRAULIC POWER UNIT, now abandoned.

2. The Field of the Invention

The present invention is related to a fastener installation tool incorporating a positive pressure pintail collection system. More particularly, the present invention relates to the use of pressurized shop air to drive detached pintails through a pintail removal hose.

3. Technical Background

Pintail fasteners, including swage fasteners and rivets, are commonly used in industries ranging from aircraft and aerospace manufacturing to building construction. Each fastener includes a deformable head disposed about a shaft and a pintail, sometimes referred to as a mandrel or stem, that is detachably secured to the shaft. The fasteners are applied by using a pneudraulic installation tool. The installation tool applies a force to the fastener which deforms the fastener's head by pulling on the pintail until the pintail detaches from the shaft. The deformed head traps workpieces between portions of the fastener, thereby fastening the workpieces together.

Some fastener installation tools are powered solely by air pressure which is generally provided by "shop air" at approximately 90 psi. Such installation tools include pistons which convert the air pressure into greatly intensified hydraulic fluid pressure which drives a hydraulic piston to provide the pull forces required to install the fasteners. However, because such tools include integral pressure intensification mechanisms, they are often heavy and awkward to use.

As a result of such disadvantages, installation tools which are powered through pressurized hydraulic and pneumatic lines that connect the tool to a remote pneudraulic power unit have been developed. The hydraulic pressure intensification is performed at the power unit and is supplied to the tool via a hose, thereby greatly reducing the weight of the tool. Indeed, an improved power unit for use in such an application is disclosed in applicant's parent application, United States patent application Ser. No. 08/427,599, filed Apr. 24, 1995 and entitled Pneudraulic Power Unit, which application is incorporated herein by this reference. With such a power unit, multiple tools may be operated.

Tools which have been designed for use with such remote power units suffer from a variety of disadvantages. One such disadvantage which is frequently encountered in fastener installation tools, particularly those designed for use with remote power units, is achieving satisfactory disposal of detached pintails. Without implementing some type of pintail collection system, the floor of the work place will quickly become littered with spent pintails.

Typically, at the time the pintail becomes detached from the fastener head, the pintail is positioned within a bore located in the nose assembly of the tool. Thus, conventional prior art methods of collecting disposed pintails include configuring tools which extend the nose assembly bore out the tail end of the tool and include a pintail collection chamber mounted to the tail end of the tool. Such tools are generally configured such that upon detachment of the pintail, a vacuum is generated which draws the pintail through the bore and into the pintail collection chamber.

One disadvantage to such pintail collection systems is that the pintail collection chamber must be frequently emptied by the operator, thereby decreasing fastener installation efficiency. Additionally, including the pintail collection chamber as an integral part of the hand-held portion of the tool increases the weight of the tool and makes it more awkward to maneuver, particularly when the pintail collection chamber becomes weighted with pintails.

In an attempt to eliminate the integral pintail collection chamber, some tools designed for use with remote power rigs utilize a pintail return line which effectively extends the bore within the tool back to the power rig. Vacuum pressure generated at the power rig draws the detached pintails through the pintail return line and into the power rig.

Such proposed solutions are generally inadequate because of the physical limitation on the amount of pressure which may be generated by a vacuum-based system. The hoses through which pintails must travel impose substantial frictional forces on the pintails, which forces must be overcome by the forces generated by vacuum pressure. With maximum theoretical vacuum pressure limited to about 14.7 psi, the forces imposed by vacuum pressure on detached pintails are generally insufficient to permit hoses longer than six to eight feet to be successfully employed. When utilizing modern power rigs, such as the rig disclosed in applicant's parent application, multiple tools are driven by a single rig. If the tool operator is restricted to a six to eight foot hose, the advantage of a multiple-tool power rig is greatly diminished.

Further, if the hose happens to become tightly coiled during use, it will plug with pintails causing the vacuum pressure at the tool to be substantially reduced or eliminated. The lack of a substantial pintail driving force also prevents pintails from being removed through hoses which extend up elevations, as the additional forces imposed by gravity quickly overcome the forces created by the vacuum pressure.

From the foregoing, it will be appreciated that it would be an advancement in the art to provide a durable, light-weight fastener installation tool which could be driven with a remote power rig.

Indeed, it would be an advancement in the art if such a tool incorporated a pintail collection system which could be used with a power rig, while not substantially increasing the weight or physical dimensions of the tool.

It would be an additional advancement in the art to provide such a tool having a pintail collection system which would permit long hoses (up to 25 feet) to be utilized, thereby more fully taking advantage of the multiple-tool features of modern power rigs.

It would be yet an additional advancement to provide such a tool having such a pintail collection system which would effectively function even if the hoses became tightly coiled or were extended up elevations.

Such a fastener installation tool is disclosed and claimed herein.

BRIEF SUMMARY AND OBJECTS OF THE INVENTION

The present invention is directed to a novel tool for use in installing fasteners in workpieces. The tool may be used to install any fastener which is capable of being installed by application to the fastener of an installation force which deforms or swages a collar or head of the fastener to secure the fastener in place. Such fasteners include blind rivets and lock bolts. In one embodiment, the tool of the present invention includes a piston cylinder and a piston which is slidably disposed within the piston cylinder. The piston is configured to move between a home position and a retracted position. The piston cylinder includes a forward piston chamber which is positioned forward of the piston and a return piston chamber positioned rearward of the piston.

A supply of pressurized hydraulic fluid is positioned in fluid communication with the forward piston chamber. The pressurized hydraulic fluid provides the driving force for retracting the piston from the home position to the retracted position to thereby apply the installation force to the fastener.

The tool also includes an air return chamber which is defined in part by the return piston chamber. In this preferred embodiment, the air return chamber includes various chambers configured within a handle of the tool. The air return chamber is preferably configured with a volume approximately equal to twice the stroke volume of the piston.

In alternative embodiments, the air return chamber includes a volume adjustment mechanism for permitting a user to adjust the volume of the air return chamber. One such embodiment employs a plug which may be inserted into a portion of the air return chamber for reducing its volume. An alternative embodiment utilizes a cylindrical channel which is configured with threads into which a screw plunger may be threadably engaged for adjusting the volume within the cylindrical channel, thereby controlling the maximum pressure generated within the air return chamber.

A supply of air, preferably "shop air," at a pressure of about 90 psi is connected in fluid communication with the air return chamber with a one-way valve, or check valve, positioned between the supply of pressurized air and the air return chamber. The one-way valve is oriented to permit the flow of air from the supply of pressurized air to the air return chamber.

In a presently preferred embodiment of the invention, the one-way valve includes a ball and seat positioned within a cylindrical chamber configured in the handle of the tool. A cylindrical spacer tube is positioned within the cylindrical chamber for positioning the ball a maximum distance from the seat while permitting the flow of air through the cylindrical chamber.

In accordance with a second aspect of the present invention, the nose assembly is configured with a nose assembly passage which extends longitudinally through the nose assembly. Likewise, the piston is configured with a piston passage which extends longitudinally through the piston. The piston passage is in fluid communication and extends collinearly with the nose assembly passage.

Further, the tool includes a back cap which is connected to the tail end of the piston cylinder. The back cap is configured with a back cap bore which extends longitudinally through the back cap. The back cap bore is in fluid communication and extends collinearly with the piston passage. Thus, the nose assembly passage, the piston passage, and the back cap bore form one continuous passage.

The tool includes a pintail bore which includes the nose assembly passage, the piston passage, and the back cap bore. Further, in a presently preferred embodiment, the pintail bore also includes a flexible pintail return hose which is connected at its nose end to the back cap bore. The pintail return hose will generally be at least ten feet long and preferably is about 25 feet long. The pintail return hose is connected at its tail end to a pintail collection chamber which is vented to ambient pressure.

Importantly, an air channel extends through the back cap and meets the back cap bore at an air orifice. The air channel is oriented at an acute angle with respect to the portion of the back cap bore which extends between the air orifice and the nose end of the tool. A supply of pressurized air, such as 50 psi "shop air," is connected in fluid communication with the air channel such that air may flow through the air channel and into the pintail bore. The pressurized blower air is brought to the air channel via an air supply hose which is attached to the air channel to extend substantially parallel to the pintail return hose. Thus, the air supply hose and the pintail return hose both extend out the tail end of the tool.

The tool of the present invention further includes an air restriction mechanism which is configured to selectively, substantially block the flow of blower air through the nose assembly passage, thereby forcing the flow of air to exit the pintail bore through the pintail collection chamber. The tool also employs a pintail retaining device which is configured to prevent detached pintails from exiting out the nose end of the nose assembly passage. In a preferred embodiment, the pintail retaining device comprises a ratchet mechanism configured in the nose assembly.

By preventing pintails from exiting out the nose end of the nose assembly, the pintails act to substantially block the flow of air out of the nose end of the nose assembly passage, thereby acting as the air restriction mechanism.

In operation, a source of pressurized shop air is placed in fluid communication with the air return chamber. A fastener is introduced into the nose assembly of the tool and upon actuation of a trigger, a supply of pressurized hydraulic fluid is introduced into the forward piston chamber. The pressure imposed on the piston by the pressurized hydraulic fluid forces the piston to move from its home position to its retracted position, thereby exerting the installation force to install the fastener.

As the piston moves from its home position to its retracted position, the one-way valve on the air return chamber is closed and the air within the air return chamber is pressurized as the volume of the air return chamber is reduced by the stroke volume. Upon successful installation of the fastener, the trigger is released which causes the pressure on the hydraulic fluid to be released. The pressure which has developed within the air return chamber then forces the piston back to the home position.

In a presently preferred embodiment, the air return chamber has a volume approximately equal to twice the stroke volume of the piston. Thus, the pressure developed within the air return chamber is approximately twice the pressure of the shop air. Consequently, a substantial force is available upon release of the pressurized hydraulic fluid to overcome the static friction of piston seals and drive the piston back to the home position.

As the piston reaches the home position, the pressure on each side of the one-way valve becomes substantially equal and the one-way valve is released, again exposing the air return chamber to the pressure of the shop air.

Upon installation of a fastener with the tool of the present invention, the pintail is detached from the fastener. At the time of detachment, the pintail is located in the nose assembly passage within the nose assembly. Upon deployment of the tool's trigger, pressurized blower air is introduced into the air channel. The blower air consequently pressurizes the pintail bore, tending to force the pintail out of the nose of the tool through the piston passage.

The ratchet mechanism configured within the nose assembly prevents the pintail from exiting the nose assembly, thereby causing the pintail to substantially block the nose assembly passage. With the nose assembly passage blocked, the flow of air through the air channel proceeds towards the tail end of the pintail bore where it eventually vents to ambient pressure in the pintail collection chamber.

With successive installation of fasteners, the nose assembly passage and the piston passage become full of detached pintails. When a pintail reaches the air orifice where the air channel merges with the pintail bore, the flow of blower air towards the tail end of the pintail bore forces the pintail to travel through the pintail return hose and into the pintail collection chamber.

Thus, it is an object of the present invention to provide a durable, light-weight fastener installation tool which is driven by a remote power rig.

It is a further object of the present invention to provide such a tool which incorporates a pintail collection system which may be used with a power rig, while not substantially increasing the weight or physical dimensions of the tool.

It is an additional object of the present invention to provide such a tool having a pintail collection system which permits long hoses (up to 25 feet) to be utilized, thereby more fully taking advantage of the multiple-tool features of modern power rigs.

Another object of the present invention is to provide such a tool which has a pintail collection system which effectively functions even if the hoses become tightly coiled or are extended up elevations.

These and other objects and advantages of the present invention will become more fully apparent by examination of the following description of the preferred embodiments and the accompanying drawings.

BRIEF DESCRIPTION OF THE DRAWINGS

A more particular description of the invention briefly described above will be rendered by reference to the appended drawings. Understanding that these drawings only provide information concerning typical embodiments of the invention and are not therefore to be considered limiting of its scope, the invention will be described and explained with additional specificity and detail through the use of the accompanying drawings, in which.

DETAILED DESCRIPTION OF THE PREFERRED EMBODIMENTS

Figure 1:
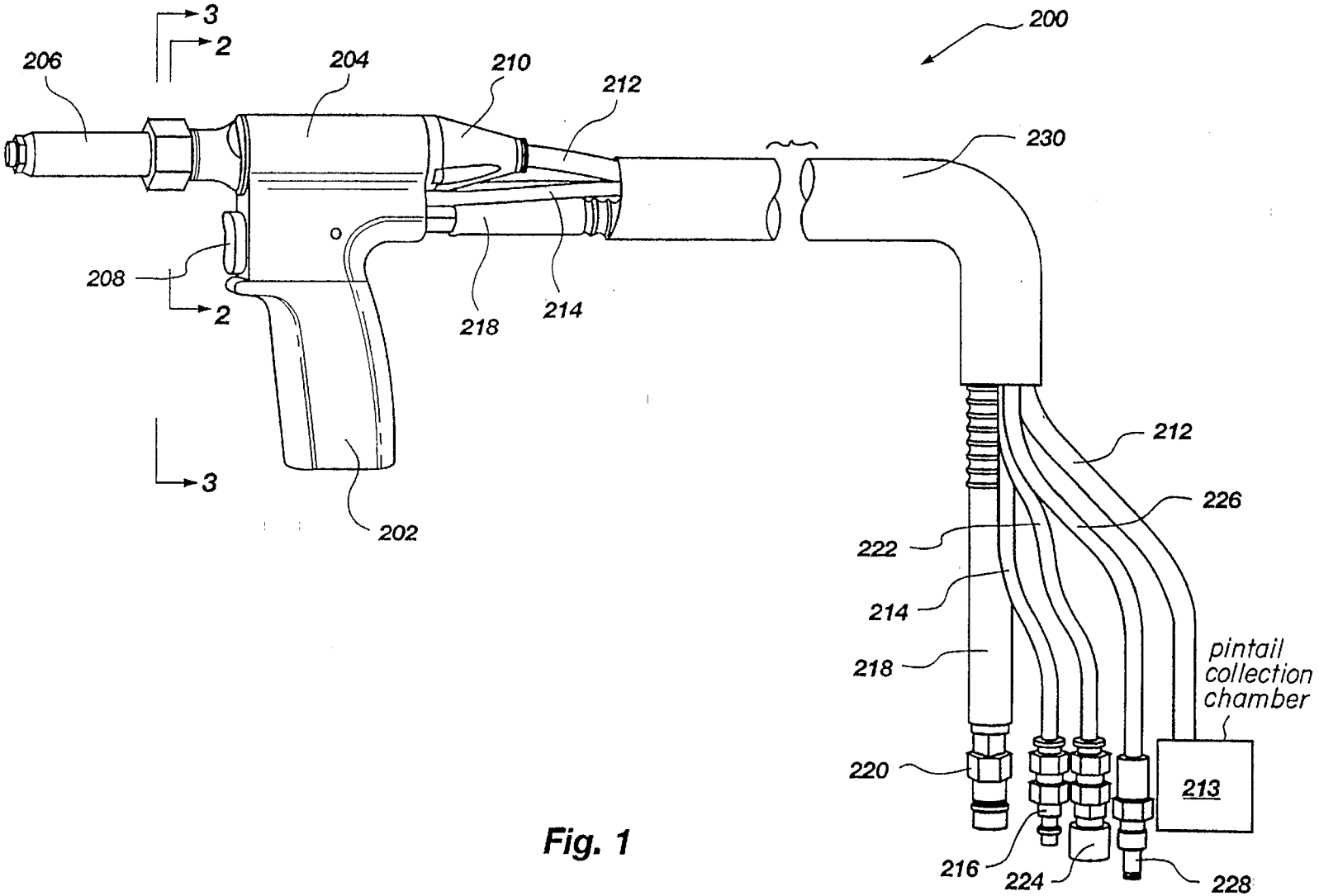
FIG. 1 is a perspective view of one embodiment of the tool of the present invention.

Reference is now made to the figures wherein like parts are referred to by like numerals throughout. With particular reference to FIG. 1, a fastener installation tool according to the present invention is generally designated at 200. In the presently preferred embodiment illustrated herein, the fastener installation tool 200 is designed for use with a pneudraulic power rig, such as that disclosed and claimed in applicant's parent application which has been incorporated herein.

The fastener installation tool 200 may be used in the installation of fasteners of the general type which have a head or collar which deforms or swages in place when subjected to an installation force which is applied by the tool. The fastener is held within the tool by jaws which grip a pintail extending out of the fastener. Upon installation of the fastener, the pintail is detached.

As illustrated in FIG. 1, the tool 200 includes a handle 202 which is attached to a piston cylinder 204. A nose assembly 206 is attached to the nose end of the piston cylinder 204. The nose assembly 206 may include any of those conventionally known nose assemblies for use in installing pintail fasteners and will vary according to the particular type of fastener to be installed.

The base of the piston cylinder 204 is configured with a trigger assembly which includes a trigger 208 which may be actuated to commence the installation cycle of the tool. A back cap 210 is attached to the tail end of the piston cylinder 204. Extending out of the back cap 210 is a pintail return hose 212 through which detached pintails are removed from the installation site. The pintail return hose 212 may include any flexible hose having a relatively smooth interior, such as many commercially available plastic hoses. The tail end of the pintail return hose 212 is attached to a pintail port of a pintail collection chamber 213 which is vented to ambient pressure, such as one configured integrally with a remote power rig.

Extending out of the tail end of the piston cylinder 204 is a supply air line 214 which connects via a fitting 216 into a source of pressurized air (not shown). The source of pressurized air may include shop air which is typically pressurized to about 90 psi. A hydraulic fluid line 218 also extends out the tail end of the piston cylinder 204. The hydraulic fluid line 218 includes a fitting 220 at its tail end with which it may be attached to the hydraulic port of a power rig or other apparatus capable of supplying pressurized hydraulic fluid. The hydraulic fluid line 218 may include any commercially available high-pressure hose known for use in delivering pressurized hydraulic fluid.

In this presently preferred embodiment of the invention, the tool 200 also includes an air control signal line 222 having a fitting 224 at its tail end for attachment to a control air port in a power rig. A blower line 226 also extends out the tail end of the piston cylinder 204 to function as an air supply line for the pintail collection system, as will be explained in greater detail below. The blower line 226 includes a fitting 228 with which the blower line 226 may be attached to a source of pressurized air which may be selectively activated, such as that provided in the pneudraulic power rig disclosed in applicant's parent application.

The lines 212, 214, 218, 222, and 226 are wrapped together with an overwrap 230 to facilitate use of the tool. It is presently preferred to utilize a fabric overwrap (not shown) having a hook-and-loop fastening system, such as that sold under the VELCRO trade name, extending along the length of the overwrap to accommodate easy installation and removal of the overwrap 230.

To assist in the proper installation of the hoses, the hoses are preferably color coded. The hoses are preferably at least ten feet long, and in this preferred embodiment, the hoses are approximately 25 feet long, thereby giving greater flexibility to the use of a multiple-tool power rig.

Figure 2:
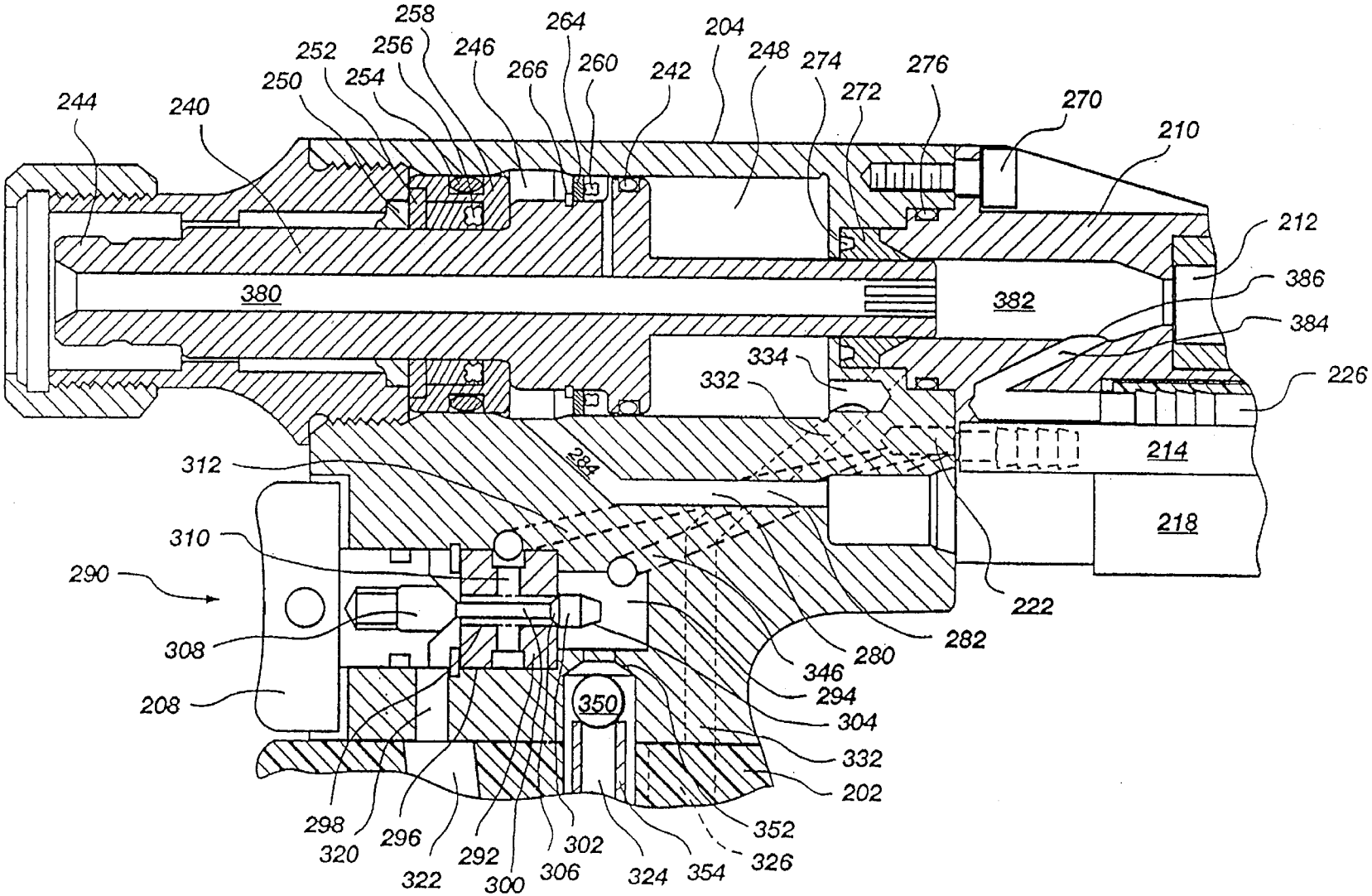
FIG. 2 is a cross-sectional view taken along line 2—2 of FIG. 1, with the nose assembly of the tool detached.

The assembly of the tool will be described with reference to FIG. 2. As illustrated in FIG. 2, a piston 240 is slidably disposed within the piston cylinder 204. The piston 240 is configured with an O-ring seal 242 to ensure an effective seal between the piston 240 and the piston cylinder 204. The nose end 244 of the piston 240 is configured for attachment to a nose assembly (206 in FIG. 1), as is commonly known in the art of fastener installation tools.

Figure 3:
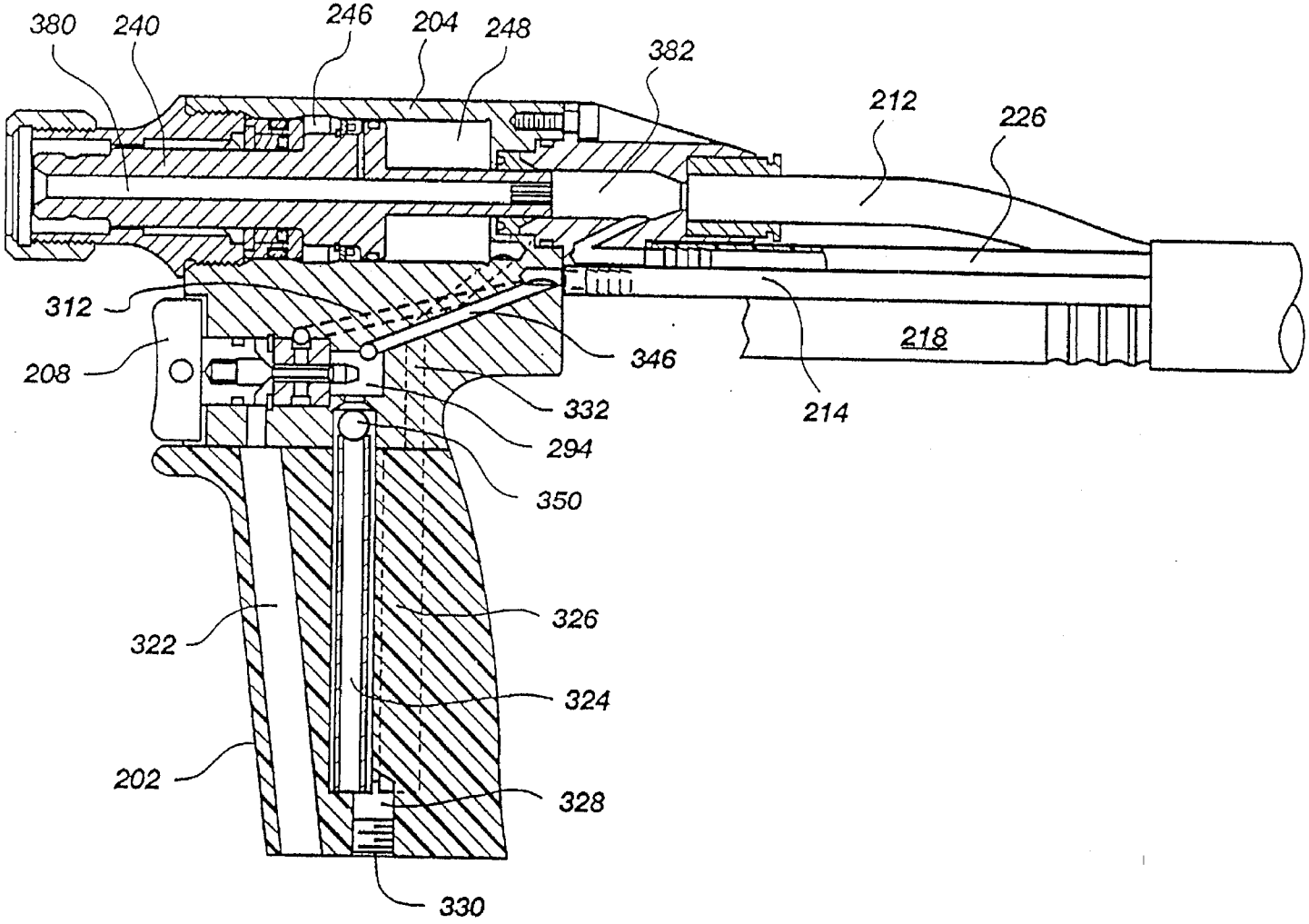
FIG. 3 is a cross-sectional view taken through line 3—3 of FIG. 1, with the nose assembly of the tool detached.
Figure 4:
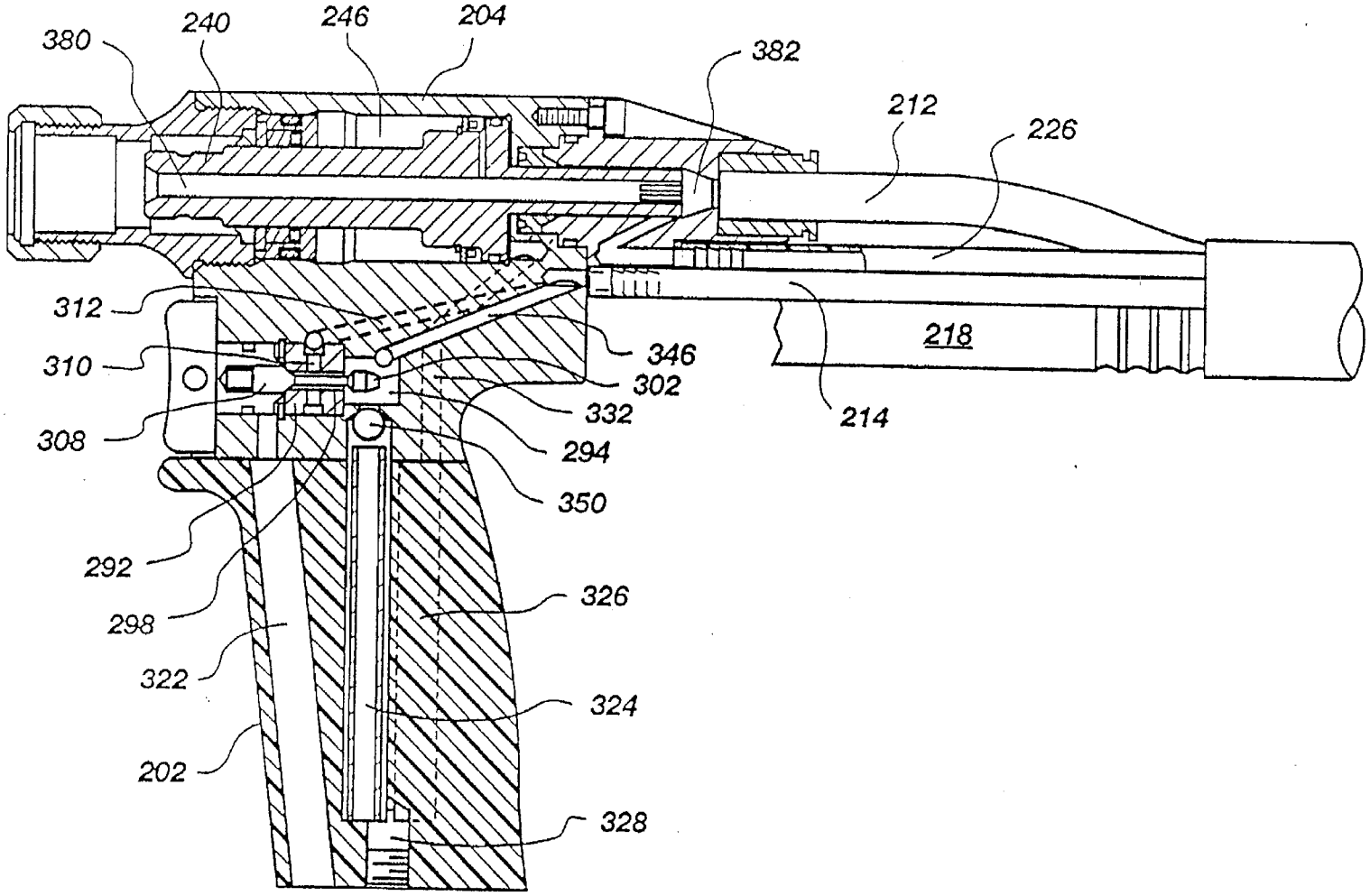
FIG. 4 is a cross-sectional view similar to that illustrated in FIG. 3, but with the trigger retracted and the piston in its retracted position.

The piston 240 is configured to move between a home position (FIGS. 2 and 3) and a retracted position (FIG. 4). The piston 240 thus defines a forward piston chamber 246 which is positioned forward of the piston and a return piston chamber 248 positioned rearward of the piston. The nose end of the forward piston chamber 246 is sealed by a wiper seal 250 employed in combination with a gland cap 252, an O-ring seal 254, a polyseal 256, and a front gland 258. The tail end of the forward piston chamber 246 is similarly sealed through the use of a polyseal 260 which is held in place with a washer 264 and a retaining ring 266.

The tail end of the piston cylinder 204 is configured in mating engagement with the back cap 210 which is mounted to the piston cylinder 204 with a series of mounting nuts 270. In order to keep the weight of the tool to a minimum, the back cap 210 is preferably made of a high-strength, machinable plastic, such as nylon. The back cap 210 is sealed to the piston cylinder 204 by a uniquely configured wiper seal 272 used in combination with an O-ring seal 274 to prevent leakage from the return piston chamber 248. A second O-ring 276 is also provided to prevent air leakage into the back cap 210 as will be explained below in greater detail.

With continued reference to FIG. 2, the piston cylinder 204 is configured with a hydraulic fluid passage 280 through which a supply of pressurized hydraulic fluid may be introduced from the hydraulic fluid line 218 into the forward piston chamber 246. The hydraulic fluid passage 280 may be configured in the piston cylinder 204 simply by drilling a longitudinal portion 282 of the passage from the tail end of the piston cylinder and drilling a connecting line 284 from the interior of the piston cylinder to a point of intersection with the longitudinal portion 282.

The piston cylinder 204 also accommodates a trigger assembly 290. The trigger assembly 290 is positioned within a trigger housing formed within the piston cylinder 204. The trigger assembly 290 includes a trigger seat 292 which is press fit into the trigger housing, thereby defining an inlet pressure chamber 294. The trigger seat 292 is preferably made of a high durometer polyurethane. By press fitting the trigger seat 292 into the trigger housing, integral sealing is provided along the outside diameter 296 of the seat, thereby eliminating the necessity of employing separate seals for this purpose.

The trigger seat 292 is configured with a longitudinal bore 298 through which a poppet 300 extends. The poppet 300 is configured with a head 302 having a forward conical portion 304 with a cone angle of approximately 20 degrees. With the leading edge of the head 302 so configured, the poppet 300 may be installed into the trigger seat 292 by pushing it through the longitudinal bore 298. Thus, the poppet head 302 has a maximum outside diameter which is slightly larger than the diameter of the bore 298. In this preferred embodiment, the diameter of the bore 298 is 0.141 inches and the maximum diameter of the poppet head 302 is 0.162 inches. In order to withstand the forces imposed on the poppet 300 during installation, the poppet 300 is preferably made of a high-strength steel, such as EDT 150.

The trailing edge 306 of the poppet head 302 is similarly shaped in a conical configuration, but has a cone angle of approximately 45 degrees. The trailing edge 306 of the poppet head 302 and the diameter of the bore 298 are shaped relative to each other to permit the poppet head 302 to seal the tail end of the bore 298, as illustrated in FIG. 2. Similarly, the poppet 300 includes a nose end 308 which includes a conical configuration for sealing the nose end of the bore 298 when the trigger 208 is retracted (FIG. 4).

With continued reference to FIG. 2, the trigger 208 is attached to the poppet 300 by any of those attachment methods known in the art. In this embodiment, a drop of adhesive is used to secure the nose end 308 of the poppet 300 to the trigger 208. The trigger 208 is preferably configured with a height at least equal to the finger width of anticipated users of the tool, thereby providing a large surface area over which trigger loading may be spread and reducing strain on the user's finger. In this preferred embodiment, the trigger is approximately 1.20 inches high.

The trigger seal 292 is further configured with an air signal chamber 310 which, in this embodiment, extends perpendicular to the bore 298. The air signal chamber 310 intersects the bore 298 thereby permitting the passage of air from the bore through the air signal chamber 310.

An air signal bore 312 is configured in the piston cylinder 204 to provide fluid communication between the air signal chamber 310 and the air control signal line 222 (positioned behind the supply air line 214 in FIG. 2). The air signal bore 312 is formed by drilling a hole in the piston cylinder 204 from the connection of the air control signal line 222 to the top of the air signal chamber 310 in the trigger seat 292.

The piston cylinder 204 is further configured with an air exhaust bore 320 which places the bore 298 in fluid communication with an air exhaust channel 322 configured in the handle 202 of the tool. The air exhaust channel 322 extends through the entire height of the handle 202, thereby permitting the exhaust of air to ambient pressure through the air exhaust channel 322.

Thus, when the trigger is in the open position, as illustrated in FIG. 2, the head 302 of the poppet 300 is sealed against the tail end of the trigger seat 292, thereby preventing air flow from the inlet pressure chamber 294 into the bore 298. The nose end 308 of the poppet 300, however, is not sealed against the trigger seat 292 when the trigger is in the open position. Hence, any pressure which has developed within the air signal bore 312, the air signal chamber 310, the air control signal line 222, and the bore 298 may be vented to ambient pressure through the air exhaust channel 322.

With the trigger in a retracted position as illustrated in FIG. 4, the head 302 of the poppet 300 is unseated from the trigger seat 292 while the nose end 308 of the poppet 300 seats against the trigger seat 292. Thus, air may flow from the inlet pressure chamber 294 and into the bore 298 where the air enters the air control signal line 222 (FIG. 2) via the air signal chamber 310 and the air signal bore 312. In this retracted position, air is prevented from venting to ambient pressure through the air exhaust channel 322.

Referring now to FIG. 3, the tool of the present invention is also configured with an air return chamber. The air return chamber is defined in part by the return piston chamber 248. In this preferred embodiment, the air return chamber also includes a number of other chambers positioned within the piston cylinder 204 and the handle 202. In particular, the air return chamber also includes a first cylindrical chamber 324 which extends from the inlet pressure chamber 294 down towards the bottom of the handle 202. The air return chamber also includes a second cylindrical chamber 326 (illustrated with phantom lines) extending adjacent (but out of plane) to the first cylindrical chamber 324.

The first and second cylindrical chambers 324 and 326 are formed by drilling into the top of the handle 202 prior to attachment of the handle 202 to the piston cylinder 204. As illustrated in FIG. 3, the first and second cylindrical chambers 324 and 326 are placed in fluid communication with each other via a connecting bore 328 which is drilled into the bottom of the handle to intersect both chambers 324, 326. The connecting bore is sealed with a cap screw 330.

With reference to FIGS. 2 and 3, the air return chamber also includes a return air connecting bore 332 which extends within the piston cylinder 204 and connects the second cylindrical chamber 326 to the return piston chamber 248. As illustrated in FIG. 2, the return air connecting bore 332 extends behind the hydraulic fluid passage 280. Importantly, the connecting bore 332 does not intersect the hydraulic fluid passage 280.

The return air connecting bore 332 is formed by drilling into the piston cylinder 204 from the top and the bottom such that the bottom of the return air connecting bore 332 is aligned with the second cylindrical chamber 326 upon assembly with the handle 202. The top portion of the return air connecting bore 332 is sealed by the wiper seal 272 and is placed in fluid communication with the return air chamber through a channel 334.

The channel 334, return air connecting bore 332, and the first and second cylindrical chambers 324 and 326 are preferably sized to have a volume approximately equal to the stroke volume of the piston. Stated another way, the air return chamber (which includes the return piston chamber) preferably has a volume approximately equal to twice the stroke volume of the piston.

In alternative embodiments, the air return chamber is configured with a volume adjustment mechanism for permitting a user to adjust the volume of the air return chamber. One such embodiment, as illustrated in FIG. 3*a* employs a plug 336 which may be inserted into a portion of the air return chamber for reducing its volume. In the illustrated embodiment, the connecting bore 328 is configured with respect to the second cylindrical chamber 326 such that the plug 336 may be placed in the second cylindrical chamber 326.

Figure 3B:
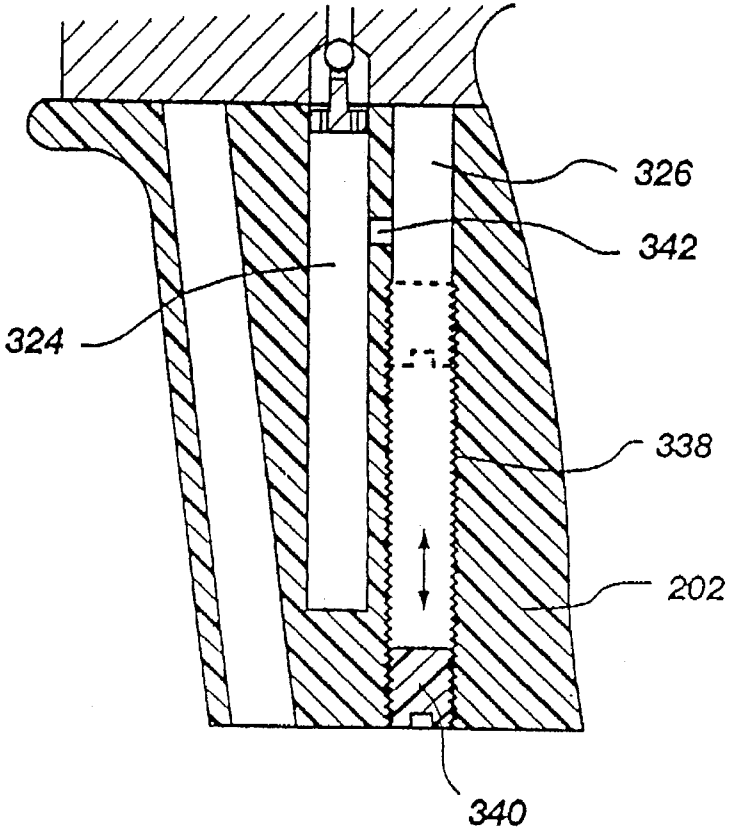
FIG. 3*b* is a cross-sectional view of a handle of yet an additional embodiment of the present invention.
Figure 3A:
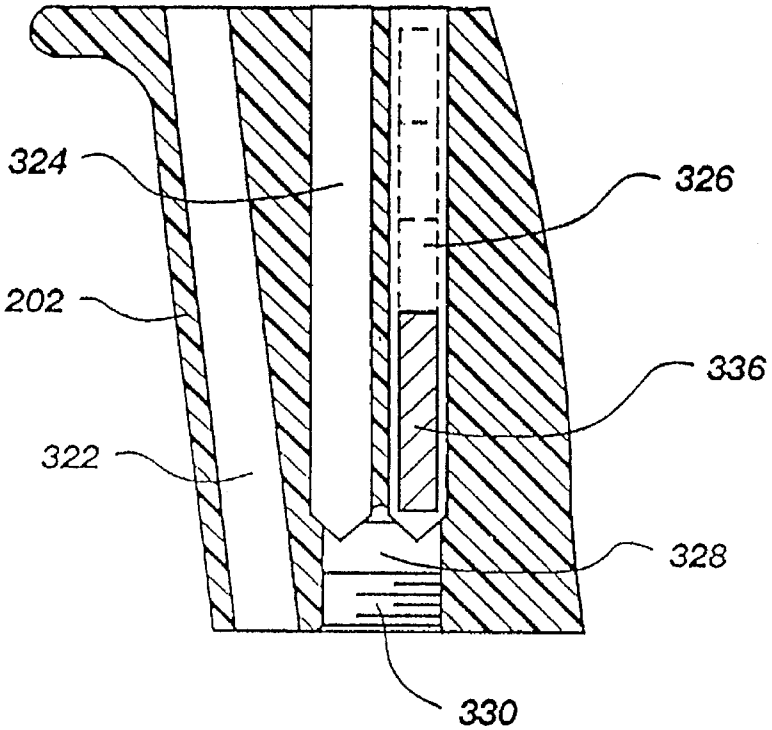
FIG. 3*a* is a cross-sectional view of the handle of an alternative embodiment of the present invention.

In a second alternative embodiment, as illustrated in FIG. 3*b*, the second cylindrical chamber 326 is configured with threads 338 into which a screw plunger 340 may be threadably engaged for adjusting the volume within the second cylindrical chamber 326. The screw plunger 340 is preferably made of a hard elastomeric or plastic material. In this embodiment, the first cylindrical chamber 324 is connected to the second cylindrical chamber 326 via a cross-port 342 located towards the top of the chambers. Thus, as the screw plunger 340 is inserted further into the second cylindrical chamber 326, the volume of the air return chamber is reduced thereby increasing the maximum pressure which is generated within the air return chamber.

Referring again to FIGS. 2 and 3, the supply air line 214 is placed into fluid communication with the inlet pressure chamber 294 by a supply air bore 346. The supply air bore 346 is formed by drilling a hole of suitable diameter through the piston cylinder 204 from the point of connection of the supply air line 214 to the top of the inlet pressure chamber 294, taking care not to intersect the hydraulic fluid passage 280, the air signal bore 310, or the return air connecting bore 332, all of which pass through that portion of the piston cylinder 204.

As illustrated in FIG. 2, a one-way, or check, valve 348 is positioned between the inlet pressure chamber 294 and the first cylindrical chamber 324. The one-way valve 348 is oriented to permit the flow of air from the supply air line 214 to the air return chamber. One of skill in the art will readily appreciate that a variety of one-way valves may be utilized. In this embodiment, the one-way valve 348 comprises a ball 350 which may seal against a seat 352. The seat 352 is configured within the end of the first cylindrical chamber 324.

A cylindrical spacer tube 354 is positioned within the first cylindrical valve chamber 324 for positioning the ball 350 a maximum distance from the seat while permitting the flow of air through the first cylindrical chamber 324. Upon air flow from the first cylindrical chamber 324 into the inlet pressure chamber 294, the ball 350 is forced against the seat 352, thereby sealing the air return chamber.

The handle 202 is attached to the piston cylinder 204 with screws (not shown) which are positioned in additional channels extending upwardly in the handle 202. Thus, the screws extend. upwardly into the piston cylinder 204 from the upper portion of the handle 202. Of course, one of skill in the art will appreciate that the handle may be attached to the piston cylinder 204 by a number of methods which are not critical to the teachings of the present invention.

Figure 5:
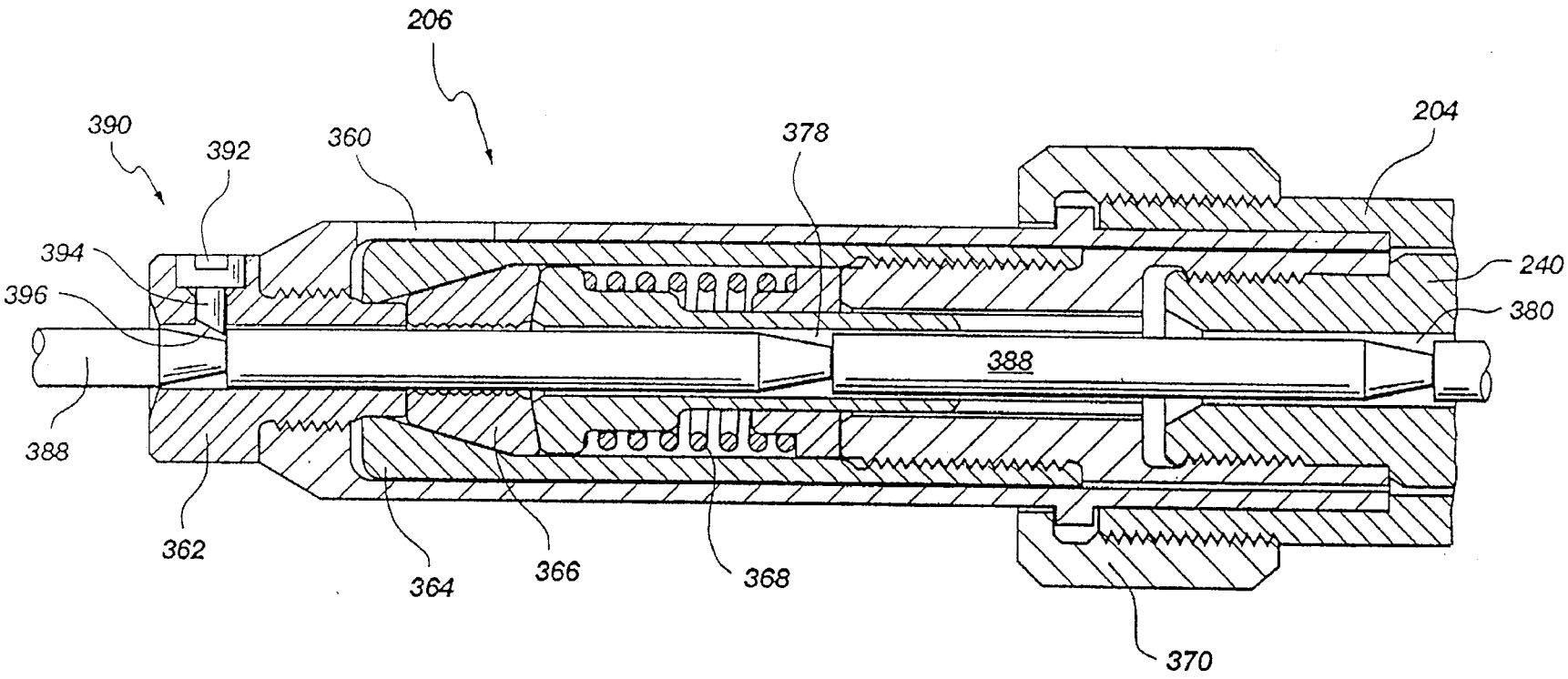
FIG. 5 is a cross-sectional view of one presently preferred embodiment of a nose assembly suitable for use with the tool of the present invention, showing several detached pintails within the pintail bore.

With reference now to FIG. 5, one presently preferred embodiment of a nose assembly 206 is illustrated. The nose assembly 206 includes a housing 360 to which an anvil 362 is threadably attached. A jaw assembly is slidably positioned within the housing 360. The jaw assembly includes a collet 364, jaws 366, and a spring 368 for biasing the jaws towards the nose end of the nose assembly. The nose assembly 206 is attached to the piston cylinder 204 with a retaining nut 370, in accordance with attachment methods which are well known in the art.

In accordance with the teachings of one aspect of the present invention, the tool includes a pintail bore which extends longitudinally through the tool. As illustrated in FIG. 5, the pintail bore comprises a nose assembly passage 378 which extends longitudinally through the nose assembly 206. When the nose assembly 206 is attached to the piston cylinder 204, the nose assembly passage 378 becomes aligned with a corresponding piston passage 380 extending longitudinally through the piston 240. Hence, the piston passage 380 is in fluid communication and extends collinearly with the nose assembly passage 378.

As illustrated in FIG. 2, the piston passage 380 is in fluid communication and extends collinearly with a back cap bore 382 which extends longitudinally through the back cap 210. Thus, in this embodiment, the pintail bore comprises the nose assembly passage 378, the piston passage 380, and the back cap bore 382 which form one continuous passage extending longitudinally through the tool.

In this presently preferred embodiment of the invention, the pintail bore also includes the flexible pintail return hose 212 which is connected at its nose end to the back cap bore 382. The opposite end of the pintail return hose 212 is connected to a pintail collection chamber 213 which is vented to ambient pressure. One presently preferred pintail collection chamber is that disclosed in the power rig of applicant's parent application.

The pintail return hose 212 will generally be at least ten feet long, thereby providing the user of the tool with sufficient freedom of movement when using the tool. In this preferred embodiment, in which three tools are simultaneously powered from a single power rig, the pintail return hose is about 25 feet long.

The pintail return hose 212 may be made of any of a variety of flexible materials having a generally smooth inside wall, thereby permitting detached pintails to travel along the hose without encountering substantial frictional resistance. One such suitable pintail hose 212 is made of polyurethane.

Importantly, an air channel 384 extends through the back cap 210 and meets the back cap bore 382 at an air orifice 386, as illustrated in FIG. 2. The air channel 384 is oriented at an acute angle with respect to the portion of the back cap bore 382 which extends between the air orifice 386 and the nose end of the tool. The air channel 384 is in fluid communication with the blower line 226, thereby providing access for pressurized air into the air channel 384.

With reference again to FIG. 5, the tool of the present invention is configured with an air restriction mechanism configured to selectively, substantially block the flow of air through the nose assembly passage 378. By blocking the flow of air through the nose assembly passage 378, air entering the back cap bore 382 from the blower line 226 is forced out the pintail return hose 212 (FIG. 2), thereby carrying with it any detached pintails and depositing those pintails in the pintail collection chamber.

The present invention also employs a pintail retaining device which prevents detached pintails from exiting out the nose end of the nose assembly passage 378. Thus, detached pintails 388 are retained within the nose assembly passage 378, as illustrated in FIG. 5. As additional pintails 388 are accumulated within the nose assembly passage 378, pintails are forced into the piston bore 380. Eventually, a sufficient number of pintails are retained within the tool that they reach the back cap bore 382 (FIG. 2) and are subjected to air flowing through the air orifice 386 and are carried down the pintail return hose 212 to the pintail collection chamber.

In this preferred embodiment of the present invention illustrated in FIG. 5, the pintail retaining device comprises a ratchet mechanism 390 configured in the nose assembly 206. The ratchet mechanism 390 comprises a spring clip 392 which biases a ratchet pin 394 towards the nose assembly passage 378. The tip 396 of the ratchet pin extends into the nose assembly passage 378, thereby preventing detached pintails 388 from exiting out the nose end of the nose assembly 206. The tip 396 is configured at an angle with respect to the nose assembly passage 378, thereby permitting pintail fasteners to be inserted into the nose assembly 206.

As fasteners are applied with the tool of the present invention, pintails 388 accumulate within the nose assembly passage 378. Once a pintail 388 enters the nose assembly passage 378 it is prevented from falling out the nose end of the tool by the ratchet mechanism 390. Thus, the trapped pintail blocks the flow of air through the nose assembly passage 378, thereby acting as the air restriction mechanism. It should be appreciated that the air restriction mechanism and pintail retaining device of the present invention may be implemented in other configurations, all of which are within the scope of the present invention.

The operation of the tool 200 of the present invention will be described with reference to a remote power rig (not shown) which is utilized to power the tool. It should be appreciated, however, that although the tool of the present invention is designed specifically to be utilized in connection with a remote power rig, many of the features of the present invention may be incorporated on other types of tools as well.

In operation, as illustrated in FIG. 1, the supply air line 214 is attached to a pressurized source of air, which will generally be shop air at a pressure of approximately 90 psi. The hydraulic fluid line 218 is attached to a source capable of providing pressurized hydraulic fluid. Initially, the hydraulic fluid line 218 is not pressurized, but is selectively activated as described below. The pressure of the hydraulic fluid will, of course, vary according to the particular application of the tool. The presently preferred embodiment achieves a pull capacity of 3650 pounds with a hydraulic pressure of 5500 psi.

The pintail return hose 212 is attached to a pintail collection chamber. The blower line 226 is connected to a source of pressurized air. In this preferred embodiment, the pressurized air which powers the blower line may be selectively activated as described hereinafter. Finally, the air control signal line 222 is attached to a control air port in the power rig. The tool is now in a "ready" state, ready to be used for installation of a pintail fastener.

With reference now to FIGS. 2 and 3, once the tool 200 is connected to the power rig (or other source of pressurized air and hydraulic fluid) the inlet pressure chamber 294 is pressurized by the shop air provided through the supply air line 214. The force of the air pressure on the head 302 of the poppet 300 biases the trigger in the open position illustrated in FIG. 2, causing the poppet head 302 to be sealed against the trigger seat 292.

With the tool in the ready state, the first and second cylindrical chambers 324 and 326 are also pressurized with shop air, causing the return air connecting bore 332 and the return piston chamber 248 to be pressurized to the same level. The air pressure within the return piston chamber 248 forces the piston 240 towards the nose end of the piston cylinder 204, as illustrated in FIG. 2.

A pintail fastener is then positioned for attachment by inserting the pintail into the nose end of the nose assembly. The user then inserts the head of the fastener through the work pieces which are to be fastened together. With the fastener so positioned, the user presses the trigger 208 to commence the installation process.

Depression of the trigger 208 moves the trigger from the open position illustrated in FIGS. 2 and 3 to the retracted position illustrated in FIG. 4. Actuating the trigger 208 causes the poppet 300 to move to the right in FIG. 2. This movement of the poppet 300 causes the head 302 to unseat from the trigger seat 292 and forces the nose end 308 of the poppet 300 to seal against the trigger seat 292. Pressurized air may then flow from the inlet pressure chamber 294 through the bore 298, the air signal chamber 310, the air signal bore 312, and into the air control signal line 222 (positioned behind the supply air hose 214 in FIG. 2).

The increase in air pressure in the air control signal line 222 provides a pneumatic "control pulse" which signals the power rig to charge the hydraulic fluid line 218 with pressurized hydraulic fluid. Upon sensing the pneumatic control pulse, the power rig also actuates the blower line 226 by charging it with air at blower air pressure at approximately 50 psi.

Pressurized hydraulic fluid then flows through the connecting line 284 and into the forward piston chamber 246. Thus the forward piston chamber 246 is subjected to the hydraulic fluid pressure (in this embodiment, 5500 psi) while the return piston chamber 248 is charged with shop air pressure (about 90 psi). The pressure differential across the piston 240 causes the piston to move from its home position (FIGS. 2 and 3) to a retracted position (FIG. 4).

As the piston 240 deploys to its retracted position, the sudden reduction in the volume of the return piston chamber 248 forces air flow through the return air connecting bore 332, through the first and second cylindrical chambers 324 and 326, and into the inlet pressure chamber 294. Air flow into the inlet pressure chamber 294 causes the ball 350 to immediately seal against seat 352, thereby preventing air from escaping out of the air return chamber (defined by the shrinking return piston chamber 248, the return air connecting bore 332, and the first and second cylindrical chambers 324 and 326).

As deployment of the piston 240 continues, the air pressure within the air return chamber continues to increase. In this preferred embodiment, the total reduction in volume of the air return chamber due to piston deployment is about 50 percent (assuming adiabatic compression), resulting in a two-fold increase in the pressure in the air return chamber—about 180 psi upon full piston deployment.

Referring now to FIG. 5, as the piston 240 is deployed, the jaws 366 engage the pintail of the fastener and, while the head of the fastener is held stationary by the anvil 362, pull the pintail until it detaches from the head of the fastener. Upon detachment of the pintail, the pintail is positioned sufficiently far within the nose assembly 206 that the ratchet pin 394 prevents the pintail from falling out of the nose end of the nose assembly passage 378.

Upon sensing the detachment of the pintail, the user may release the trigger 208, permitting it to return to the open position illustrated in FIG. 2. Upon movement of the trigger 208 from the retracted position to the open position, the poppet 300 moves to the left (as seen in FIG. 2), thereby causing the head 302 of the poppet 300 to seal against the trigger seat 292 and causing the nose end 308 of the poppet to release its seal against the trigger seat 292. As a consequence of the movement of the poppet 300, pressure from the supply air line 214 no longer is in communication with the air control signal line 222. Pressure built up within the air control signal line 222 is now vented through the air exhaust channel 322 in the handle 202 to the ambient air.

The sudden reduction of pressure within the air control signal line 222 sends a second control pulse to the power unit to release the pressure on the hydraulic fluid line 218. Upon release of the pressure in the hydraulic fluid line 218, the pressure within the forward piston chamber 246 is now near zero while the pressure in the return piston chamber 248 has approximately doubled from its initial pressure (in this embodiment, about 180 psi). This pressure differential across the piston is sufficient to overcome the static friction barrier in the piston seals (242, 260, 262) and causes the piston 240 to pump the hydraulic fluid out of the forward piston chamber 246 and return to its home position (FIG. 2). Importantly, because the pressure within the air return chamber upon release of the trigger is substantially higher than shop air pressure, a correspondingly greater force is available to overcome the resistance imposed by static friction to initiate movement of the piston. Consequently, the speed at which the piston returns to the home position is substantially increased.

As the piston 240 moves towards its home position, the volume of the air return chamber increases, causing a corresponding reduction in pressure within the air return chamber. As the piston reaches its home position, the volume within the air return chamber has fully expanded to its prior level, resulting in the pressure within the air return chamber being substantially the same as the pressure within the inlet pressure chamber 294. With the pressure on both sides of the one-way valve being about the same, the ball 350 is released from the seat 352 and falls onto the top of the spacer tube 354. The air return chamber may then be charged by the supply air line 214.

As discussed briefly above, upon deployment of the trigger 208, the blower line 226 is charged. Upon detachment of a pintail 388, the pintail is prevented from falling out the nose end of the nose assembly 206 by the ratchet mechanism 390, as illustrated in FIG. 5. With the pintail 388 retained within the nose assembly passage 378, air from the blower line 226 which enters the pintail bore is forced through the pintail return hose 212 (FIG. 2) and into the pintail collection chamber 213 of the power rig where it is vented to ambient pressure.

Thus, as additional fasteners are installed with the tool, detached pintails will stack up within the pintail bore until the nose assembly passage 378 (FIG. 5) and the piston passage 380 are full of pintails. When a pintail reaches the portion of the back cap bore 382 to which the air channel 384 is connected (FIG. 2), the flow of air will carry the pintail down the pintail return hose 212 and into the pintail collection chamber.

Utilizing shop air at approximately 50 psi to fuel the blower line 226, it has been found that sufficient force is generated on the pintails to carry them up substantial vertical elevations through the pintail return hose 212. Additionally, air pressure of such a magnitude also permits the use of long hoses (i.e., 25 feet), thereby taking advantage of the multiple-tool features of modern power rigs. Of course, one of skill in the art will appreciate that the air pressure utilized in the blower line 226 may be varied according to the requirements of the particular application.

It is possible that the pintail return hose 212 could become tightly coiled during use of the tool, thereby physically preventing pintails from traveling through the hose. By utilizing sufficient air pressure in the blower line 226, when the coil is relaxed, the force generated by air flowing through the pintail return hose will carry the pintails to the pintail collection chamber.

It is presently preferred that power rig be configured to charge the blower line 226 for about 10–15 seconds following any fastener installation cycle. Thus, in the event the tool is left idle for any significant period of time, pressurized shop air is preserved. In a presently preferred embodiment, the blower line 226 is set on a 14-second cycle.

From the foregoing, it can be seen that the present invention provides a durable, light-weight fastener installation tool which may be driven by a remote power rig. Indeed, the present invention includes novel structure which incorporates a pintail collection system which may be used with a power rig, while not substantially increasing the weight or physical dimensions of the tool. This novel pintail collection system permits long hoses (up to 25 feet) to be utilized, thereby more fully taking advantage of the multiple-tool features of modern power rigs. Indeed, the pintail collection system effectively functions even if the hoses become tightly coiled or are extended up elevations.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A tool for use in installing fasteners in workpieces, each fastener including a detachable pintail and being capable of being installed by application to the fastener of an installation force which detaches the pintail, comprising:

a nose assembly configured to engage the pintail of the fastener and apply the installation force to the fastener, the nose assembly configured with a nose assembly passage extending longitudinally through the nose assembly;

a piston cylinder;

a piston slidably disposed within the piston cylinder, the piston having a nose end which is connectable to the nose assembly and having a piston passage extending longitudinally through the piston;

a pintail bore extending longitudinally through the tool, the pintail bore comprising the nose assembly passage and the piston passage;

an air channel which meets the pintail bore at an air orifice;

a supply of pressurized air connected in fluid communication with the air channel such that air may flow through the air channel and into the pintail bore;

a pintail collection chamber in fluid communication with the tail end of the pintail bore, the pintail collection chamber being vented to ambient pressure;

an air restriction mechanism configured to substantially block the flow of air from the air channel through the portion of the pintail bore extending toward the nose of the tool; and a pintail retaining device configured to prevent detached pintails from exiting out the nose end of the nose assembly passage.

2. A tool as defined in claim 1, wherein the pintail bore further comprises a flexible pintail return hose extending to the pintail collection chamber.

3. A tool as defined in claim 2, wherein the flexible pintail return hose is at least ten feet long.

4. A tool as defined in claim 2, further comprising an air supply hose connecting the supply of pressurized air to the air channel, the air supply hose attached to the air channel to extend substantially parallel to the pintail return hose.

5. A tool as defined in claim 1, wherein a back cap is connected to the tail end of the piston cylinder, the back cap configured with a back cap bore extending longitudinally through the back cap, the pintail bore further comprising the back cap bore.

6. A tool as defined in claim 5, wherein the air channel extends through the back cap and meets the back cap bore.

7. A tool as defined in claim 6, wherein the air channel is oriented at an acute angle with respect to the portion of the pintail bore which extends between the air orifice and the nose end of the tool.

8. A tool as defined in claim 1, wherein the air channel is oriented at an acute angle with respect to the portion of the pintail bore which extends between the air orifice and the nose end of the tool.

9. A tool as defined in claim 1, wherein the supply of pressurized air comprises air at a pressure of about 90 psi.

10. A tool as defined in claim 1, wherein the air restriction mechanism is configured to selectively block the flow of air from the air channel through the portion of the pintail bore extending toward the nose of the tool.

11. A tool as defined in claim 10, wherein the air restriction mechanism and the pintail retaining device comprise a ratchet mechanism configured in the nose assembly which prevents detached pintails from exiting out the nose end of the nose assembly passage, thereby blocking the flow of air out of the nose end of the nose assembly passage.

12. A tool for use in installing fasteners in workpieces, each fastener including a detachable pintail and being capable of being installed by application to the fastener of an installation force which detaches the pintail, comprising:

(A) a hand-held body, comprising:

(1) a nose assembly configured to engage the pintail of the fastener and apply the installation force to the fastener, the nose assembly configured with a nose assembly passage extending longitudinally through the nose assembly;

(2) a piston cylinder;

(3) a piston slidably disposed within the piston cylinder, the piston having a nose end which is connectable to the nose assembly and having a piston passage extending longitudinally through the piston, the piston passage being in fluid communication and extending collinearly with the nose assembly passage;

(4) a back cap connected to the tail end of the piston cylinder, the back cap configured with a back cap bore extending longitudinally through the back cap, the back cap bore being in fluid communication and extending collinearly with the piston passage; and (5) an air channel extending through the back cap and meeting the back cap bore at an air orifice, the air channel being oriented at an acute angle with respect to the portion of the back cap bore which extends between the air orifice and the nose end of the tool;

(6) an air restriction mechanism configured to selectively, substantially block the flow of air through the nose assembly passage; and (7) a pintail retaining device configured to prevent detached pintails from exiting out the nose end of the nose assembly passage;

(B) a supply of pressurized air connected in fluid communication with the air channel such that air may flow through the air channel and into the pintail bore;

(C) a flexible pintail return hose having a nose end connected to the back cap bore; and (D) a pintail collection chamber connected to the tail end of the pintail return hose, the pintail collection chamber being vented to ambient pressure.

13. A tool as defined in claim 12, wherein the flexible pintail return hose is at least ten feet long.

14. A tool as defined in claim 12, wherein the supply of pressurized air comprises air at a pressure of about 90 psi.

15. A tool as defined in claim 12, wherein the air restriction mechanism and the pintail retaining device comprise a ratchet mechanism configured in the nose assembly which prevents detached pintails from exiting out the nose end of the nose assembly passage, thereby blocking the flow of air out of the nose end of the nose assembly passage.

16. A tool as defined in claim 12, further comprising an air supply hose connecting the supply of pressurized air to the air channel, the air supply hose attached to the air channel to extend substantially parallel to the pintail return hose.

* * * * *